US006580402B2

(12) United States Patent
Navarro et al.

(10) Patent No.: US 6,580,402 B2
(45) Date of Patent: Jun. 17, 2003

(54) ANTENNA INTEGRATED CERAMIC CHIP CARRIER FOR A PHASED ARRAY ANTENNA

(75) Inventors: Julio Angel Navarro, Kent, WA (US); Douglas Allan Pietila, Puyallup, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/915,836

(22) Filed: Jul. 26, 2001

(65) Prior Publication Data

US 2003/0020654 A1 Jan. 30, 2003

(51) Int. Cl.[7] ..... H01Q 21/00; H01P 5/12

(52) U.S. Cl. ..... 343/853; 333/137; 333/247; 343/700 MS

(58) Field of Search ..... 343/853, 771, 343/776, 777, 778, 772, 700 MS; 333/247, 248, 136, 137, 33, 135; H01Q 21/00; H01P 5/12

(56) References Cited

U.S. PATENT DOCUMENTS

| | | | | | |
|---|---|---|---|---|---|
| 5,023,624 | A | * | 6/1991 | Heckaman et al. | 333/247 |
| 5,276,455 | A | | 1/1994 | Fitzsimmons et al. | 343/777 |
| 5,886,671 | A | | 3/1999 | Harvey et al. | 343/776 |
| 5,982,250 | A | * | 11/1999 | Hung et al. | 333/246 |
| 6,154,176 | A | * | 11/2000 | Fathy et al. | 343/700 MS |
| 6,232,919 | B1 | * | 5/2001 | Marumoto et al. | 342/372 |
| 6,249,439 | B1 | * | 6/2001 | DeMore et al. | 333/246 |
| 6,396,440 | B1 | * | 5/2002 | Chen | 81/107 |
| 2002/0003497 | A1 | * | 1/2002 | Gilbert et al. | 343/700 MS |
| 2002/0018019 | A1 | * | 2/2002 | Fourdeux et al. | 343/700 MS |

* cited by examiner

*Primary Examiner*—Don Wong
*Assistant Examiner*—Trinh Vo Dinh
(74) *Attorney, Agent, or Firm*—Harness Dickey & Pierce P.L.C.

(57) ABSTRACT

An integrated ceramic chip carrier module for a phased array antenna. The module is comprised of a plurality of layers of low temperature, co-fired ceramic formed into an integrated module. The module combines the injection molded probes, button layer and holder, and the ceramic chip carrier into a single integrated component part. This construction provides for improved performance, reliability, manufacturing repeatability, and lower overall antenna manufacturing costs.

13 Claims, 6 Drawing Sheets

ANTENNA INTEGRATED CERAMIC CHIP CARRIER FOR A PHASED ARRAY ANTENNA

FIELD OF THE INVENTION

The assignee of the present application, The Boeing Company, is a leading innovator in the design of high performance, low cost, compact phased array antenna modules. The Boeing antenna module shown in FIGS. 1*a*–1*c* have been used in many military and commercial phased array antennas from X-band to Q-band. These modules are described in U.S. Pat. No. 5,866,671 to Riemer et al and U.S. Pat. No. 5,276,455 to Fitzsimmons et al, both being hereby incorporated by reference.

BACKGROUND OF THE INVENTION

The assignee of the present application, The Boeing Company, is a leading innovator in the design of high performance, low cost, compact phased array antenna modules. The Boeing antenna module shown in FIGS. 1*a*–1*c* have been used in many military and commercial phased array antennas from X-band to Q-band. These modules are described in U.S. Pat. No. 5,886,671 to Riemer et al and U.S. Pat. No. 5,276,455 to Fitzsimmons et al.

The in-line first generation module was used in a brick-style phased-array architecture at K-band and Q-band. This approach is shown in FIG. 1*a*. This approach requires some complexity for DC power, logic and RF distribution but it provides ample room for electronics. As Boeing phased array antenna module technology has matured, many efforts made in the development of module technology resulted in reduced parts count, reduced complexity and reduced cost of several key components of such modules. Boeing has also enhanced the performance of the phased array antenna with multiple beams, wider instantaneous bandwidths and polarization flexibility.

The second generation module, shown in FIG. 1*b*, represented a significant improvement over the in-line module of FIG. 1*a* in terms of performance, complexity and cost. It is sometimes referred to as the "can and spring" design. This design can provide dual orthogonal polarization in an even more compact, lower-profile package than the inline module of FIG. 1*a*. The can-and-spring module forms the basis for several dual simultaneous beam phased arrays used in tile-type antenna architectures from X-band to K-band. The can and spring module was later improved even further through the use of chemical etching, metal forming and injection molding technology. The third generation module developed by the assignee, shown in FIG. 1*c*, provides an even lower-cost production design adapted for use in a dual polarization receive phased array antenna.

Each of the phased-array antenna module architectures shown in FIGS. 1*a*–1*c* require multiple module components and interconnects. In each module, a relatively large plurality of vertical interconnects such as buttons and springs are used to provide DC and RF connectivity between the distribution printed wiring board (PWB), ceramic chip carrier and antenna probes. Accordingly, there remains a need to even further reduce the cost of a phased array antenna module by reducing parts count, the number of manufacturing steps needed for producing the module, and assembly complexity of the module.

SUMMARY OF THE INVENTION

The present invention is directed to an integrated ceramic chip carrier module for a phased array antenna. The module combines the antenna probe (or probes) of the phased array module with the ceramic chip carrier that contains the module electronics into a single integrated ceramic component. The resulting integrated ceramic chip carrier module has fewer independent components, higher performance, improved dimensional precision and increased reliability. The module of the present invention also allows a phased array antenna to be manufactured at a lower overall cost than with previous antenna module designs.

In one preferred embodiment the module of the present invention comprises a plurality of distinct, low temperature ceramic layers which are co-fired using well known ceramic manufacturing technology to form a single module. In one preferred embodiment these layers comprise an I/O (input/output) layer, a wave guide layer and an RF probe layer. Subsequent to forming the module, a seal ring and a lid are preferably secured to the I/O layer to provide a hermetically sealed compartment for enclosing the integrated circuit chips carried on the I/O layer.

It is a principal advantage of the module of the present invention that the module requires no button holder, and no buttons or springs to facilitate the vertical DC and RF interconnects/connector between the layers of the module. The interconnects embodied in the present invention are provided by vias formed in each of the layers and filled with a suitable electrically conductive material during manufacturing of the module. This eliminates the concern over assembly/alignment tolerances that exist with conventional vertical interconnects such as buttons and springs which are needed to make the electrical connections between various layers and/or components of traditional modules. The module of the present invention further avoids the use of chemical etching/metal forming and injection molding of the antenna probes, which are all required with previous module designs.

The module of the present invention thus eliminates vertical interconnects between the ceramic chip carrier and antenna probes and takes advantage of the fine line accuracy and repeatability of multi-layer, co-fired ceramic technology. This metallization accuracy, multi-layer registration produces an even higher performance, even more stable antenna module. The integrated module of the present invention further provides enhanced flexibility, layout and signal routing through the availability of stacked, blind and buried vias between internal layers, with no fundamental limit to the layer count in the ceramic stack-up of the module.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 2:
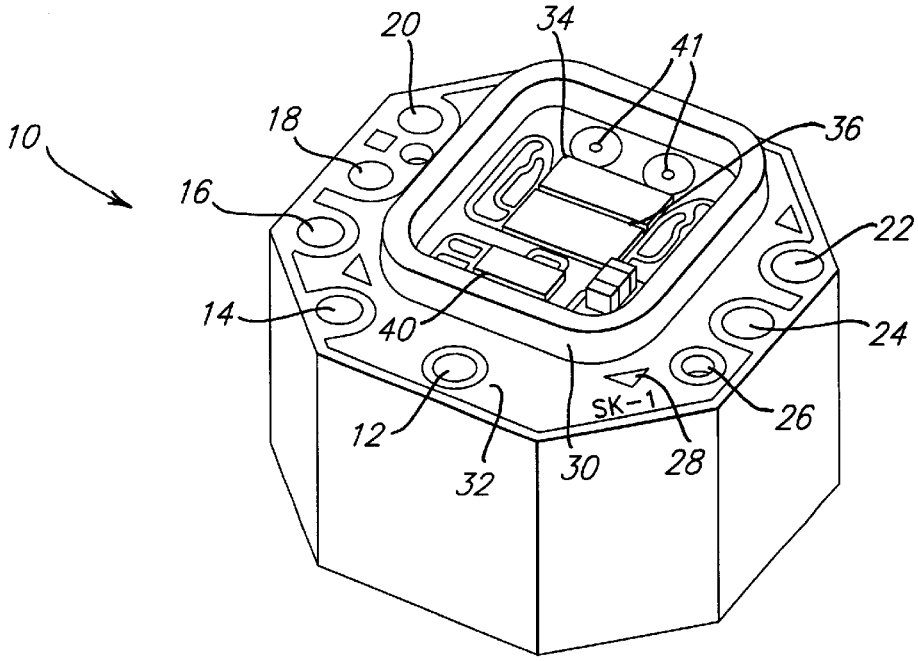
FIG. 2 is a perspective front view of the module of the present invention with the lid for the seal removed to illustrate the integrated circuit components on the I/O layer of the module.

Referring to FIG. 2, there is shown an antenna integrated ceramic chip carrier module 10 for use with a phased array antenna. Module 10 is comprised of a plurality of layers of co-fired ceramic which are co-fired using well known ceramic manufacturing technology to form a single, co-fired ceramic, integrated module. In one preferred embodiment, low temperature co-fired construction techniques are used to form the module 10, although it will be appreciated that high temperature ceramic technology is available and may be useful to employ in certain circumstances.

From FIG. 2, it can be seen that the module 10 provides a plurality of electrically conductive vertical interconnects 12–24. Interconnect 12 is a RF input interconnect for enabling an RF signal to be received by the module 12. Interconnect 14 is a clock (CLK) interconnect for providing a clock signal to the electronics of the module 10. Interconnect 16 is a "DATA" interconnect for providing phase shifter information to the module 10. Interconnects 18 and 20 provide +5 volts DC and −5 volts DC, respectively, to the module 10. Interconnects 22 and 24 similarly provide +5 volts DC and −5 volts DC to the module 10. One or more alignment holes 26 are also provided for aligning the module 10 with an external button holder (not shown). A plurality of assembly fiducials 28 are incorporated to assist automated equipment utilization.

The module 10 is shown with a seal ring 30 which is secured to a top most input/output (I/O) layer 32 such as by brazing. A lid, which would normally be secured to the seal ring 32, has been omitted to illustrate the various integrated circuits which may be carried by the I/O layer 32. When the lid is secured to the seal ring 32, a hermetically sealed enclosure is provided for the integrated circuits. The specific integrated circuits carried by the input/output layer may vary, but in one preferred form the module 10 includes a dual amplifier monolithic microwave integrated circuit (MMIC) 34, a dual phase shifter MMIC 36, a bypass capacitor 38 and a control ASIC 40 (application specific integrated circuit). The bypass capacitor 38, in one preferred form, comprises a 2200 pf capacitor. The seal ring 30 and the lid may each be comprised of Kovar™ or any other suitable material. Vertical interconnects 41 couple the dual amplifier MMIC 34 to RF antenna probes (to be discussed momentarily).

Figure 3:
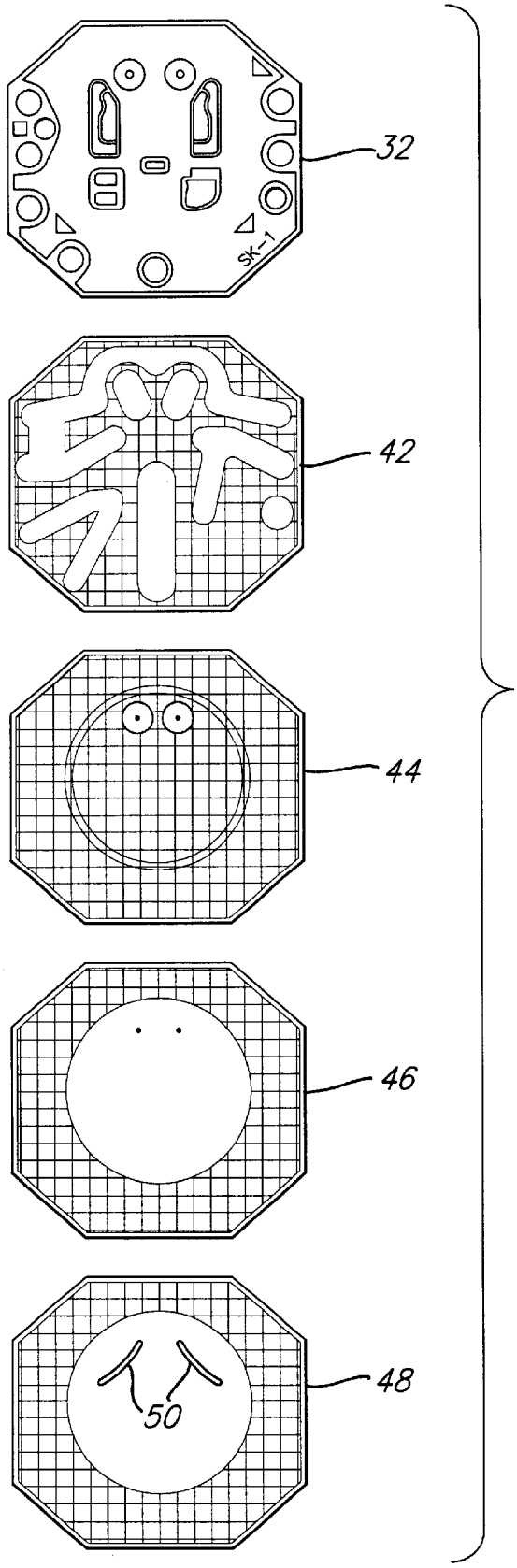
FIG. 3 is a perspective view of the independent ceramic layers of the module prior to being co-fired into an integrated module.
Figure 4:
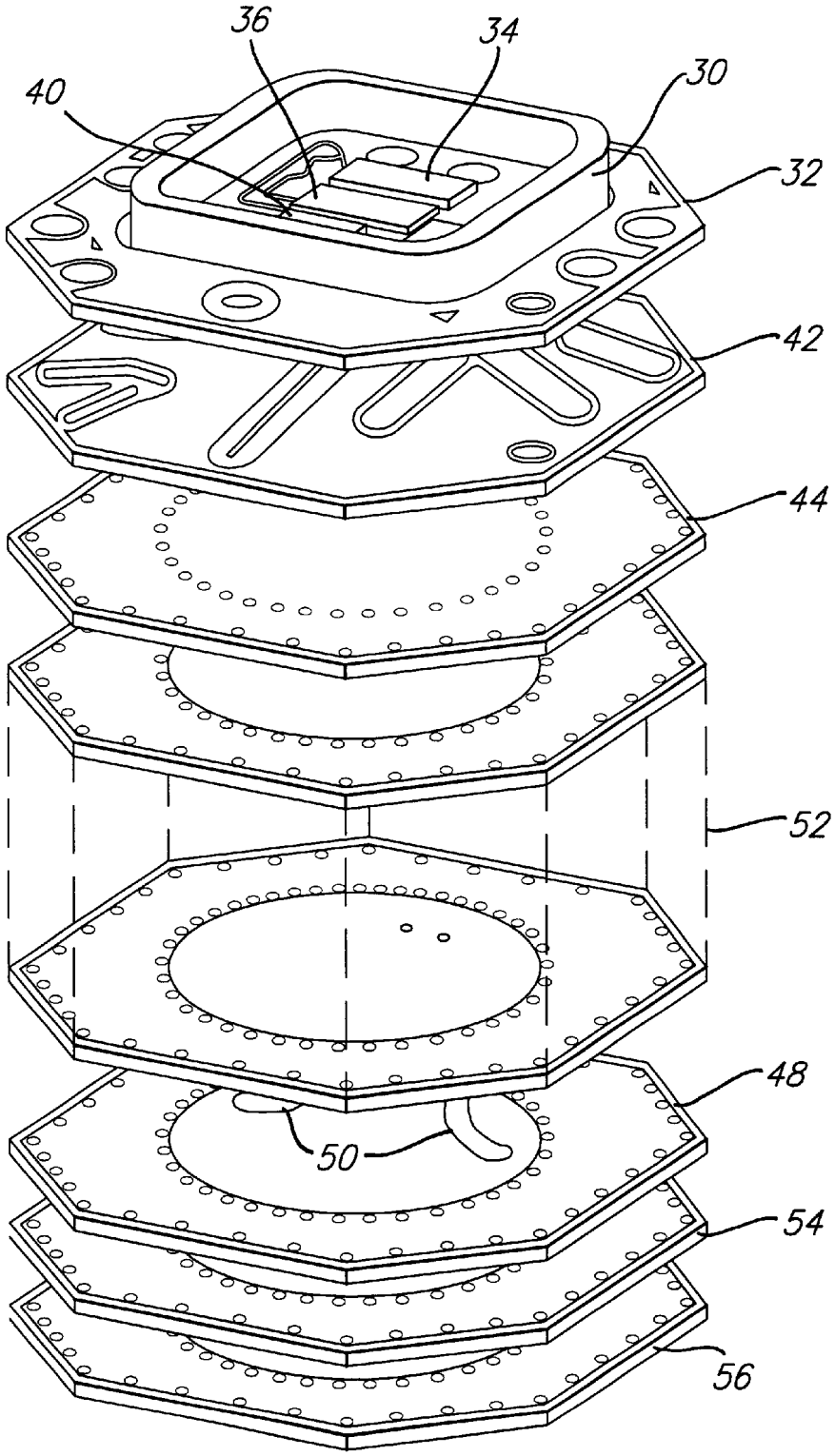
FIG. 4 is a perspective view showing the various layers forming the module disposed in vertical, spaced apart relationship from one another.

Referring to FIGS. 3 and 4, the independent layers which form the module 10 can be seen. In addition to the I/O layer 32, the module 10, in one preferred embodiment, comprises an RF & trace layer 42, a back short layer 44, at least one layer 46 for forming a waveguide layer, and an RF probe layer 48 which includes one or more RF probes 50 formed thereon. Each of the layers 32 and 42–48 are comprised of co-fired ceramic, and preferably of low temperature co-fired ceramic, which are formed into the module 10 through the above-mentioned co-fired ceramic construction technique.

With specific reference to FIG. 4, typically a plurality of layers 46 are used to form a waveguide layer 52. Also, a spacer layer 54 may be incorporated to space apart the surface of the RF probe layer 48 from the outermost surface of the module 10. An RF exit layer 56 may also be incorporated for radiation to free space.

Figure 5:
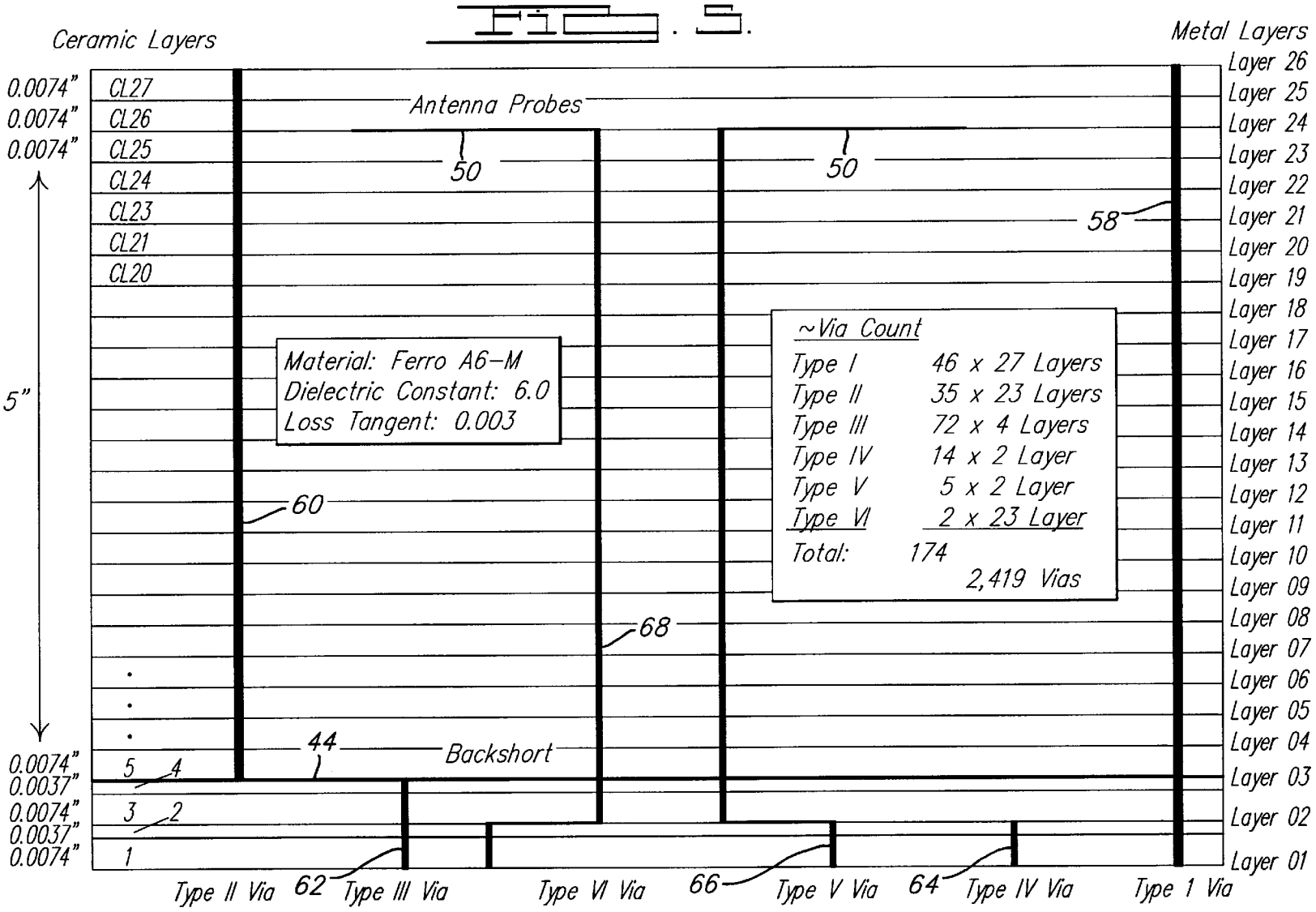
FIG. 5 is a simplified diagram illustrating the module of the present invention having 27 independent ceramic layers and a total of 2419 vias.

Referring now to FIG. 5, a simplified breakdown of the layers and the number of vias comprising the module 10 is illustrated. In this example, the module 10 comprises 27 ceramic layers and 26 metal layers. Layers 1, 3 and 5–27 each comprise co-fired ceramic layers having a thickness of 0.0074 inch (0.188 mm). Layers 2 and 4 each comprise co-fired ceramic layers having a thickness of 0.0037 inch (0.094 mm). The 26 metal layers are formed on one or both sides of each one of the co-fired ceramic layers. In this example, co-fired ceramic layer 25 represents the I/O layer 32 having antenna probes 50 formed thereon. A large plurality of vias are incorporated in the module 10 so as to extend axially through various layers of the module 10. A plurality of 46 "Type 1" vias, one of which is represented by vertical line 58, extend through all 27 co-fired ceramic layers. A plurality of 35 "Type 2" vias extend axially through 23 co-fired ceramic layers (i.e., through co-fired ceramic layers 5–27). One of the Type 2 vias is designated by reference numeral 60. A plurality of 72 "Type 3" vias extend through four co-fired ceramic layers of the module 10 (i.e., through layers 1–4). One of the Type 3 vias is designated by reference numeral 62. A plurality of 14 "Type 4" vias extend axially through two co-fired ceramic layers (i.e., co-fired ceramic layers 1 and 2) of the module 10. One of these Type 4 vias is designated by reference numeral 64. A plurality of 5 "Type 5" vias extend axially through two co-fired ceramic layers (i.e., layers 1 and 2) of the module 10. One of these Type 5 vias is designated by reference numeral 66. A plurality of two "Type 6" vias extend axially through 23 layers (i.e., through co-fired ceramic layers 3–25) of the module 10. One of these Type 6 vias is designated by reference numeral 68.

Each of the co-fired ceramic layers is formed preferably from Ferro A6-M having a dielectric constant of preferably about 6.0 and a loss tangent of preferably about 0.003. It will be appreciated, however, that other suitable materials may be employed with slightly varying dielectric constants and/or loss tangents without departing from the scope of the present invention. It will also be appreciated that the total number of co-fired ceramic layers and/or metal layers used to form the module 10, as well as the number of vias, can also vary without departing from the scope of the invention.

Figure 6:
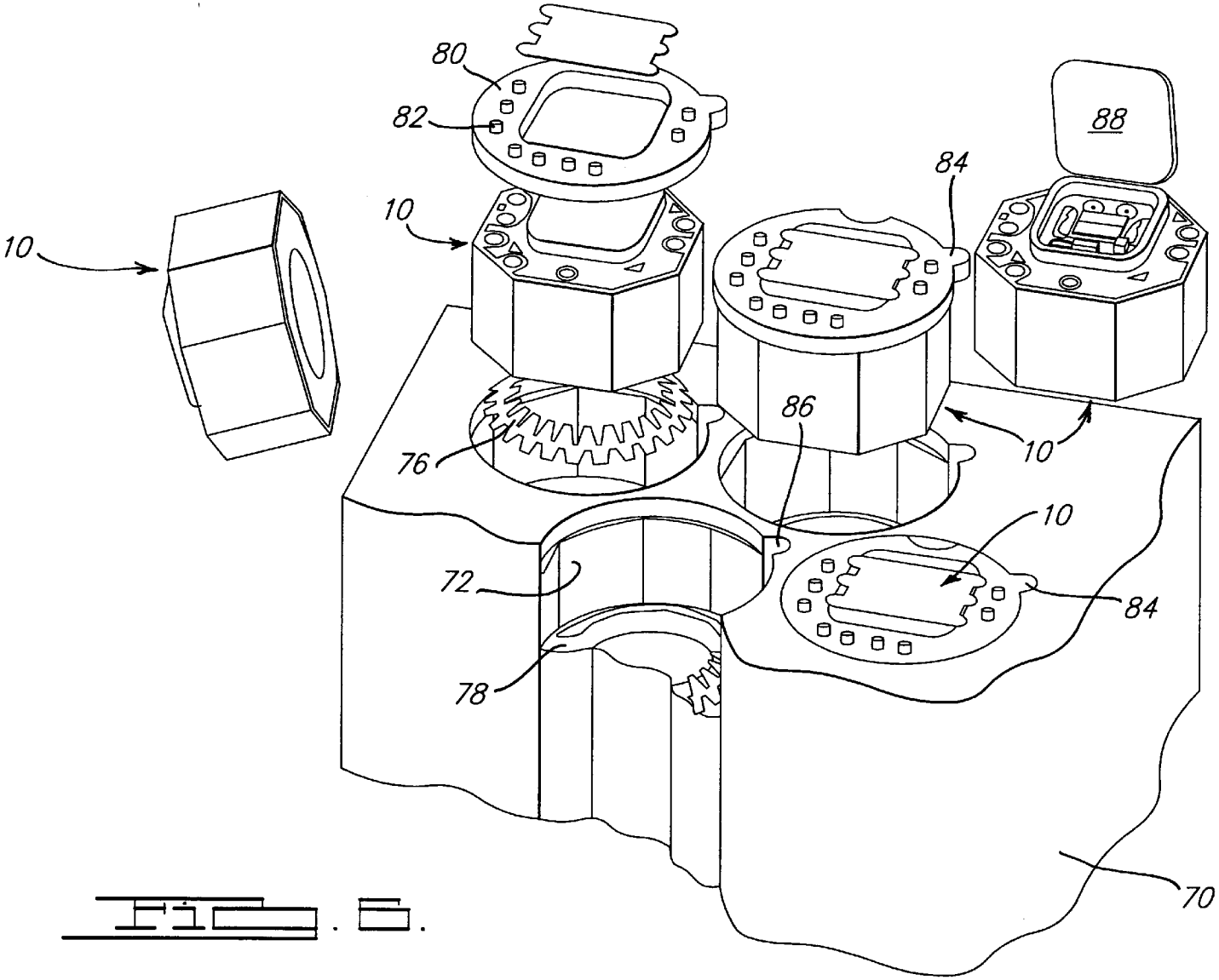
FIG. 6 is a view of a honeycomb support structure with several modules of the present invention either disposed in the support structure or shown in spaced apart relation from corresponding apertures in the support structure.

Referring to FIG. 6, several of the modules 10 are illustrated either installed, or ready for installation, into a honeycomb waveguide support structure 70. The honeycomb waveguide support structure 70 includes a plurality of bores 72, as will be well understood in the art. Each bore 72 includes a dielectric load 74. A conventional ground spring washer 76 rests on a shoulder 78 of each bore 72. One of the modules 10 is shown resting on the ground spring 76. A button contact carrier 80 is placed on the I/O layer 32 of the module 10. A plurality of button contacts 82 are placed in apertures formed in the button contact carrier 80. The carrier 80 further has a tab 84 which engages within a notch 86 adjacent the bore 72 formed in the honeycomb support structure 70 such that the carrier 80 is held in a precisely aligned orientation within one of the bores 72 relative to the module 10. A lid 88 is also shown secured to the seal ring 30 on each of the modules 10 illustrated in FIG. 5.

Figure 1A:
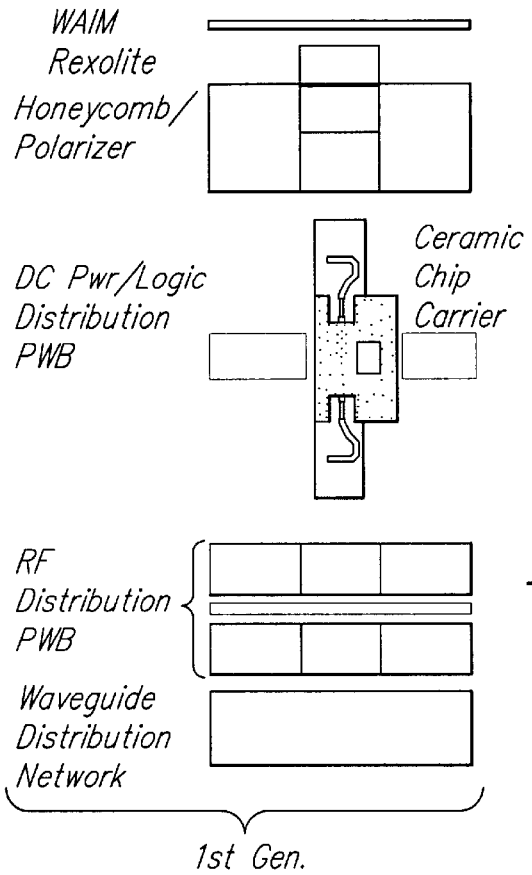
Prior Art FIG. 1a.
FIGS. 1*a*–1*c* represent prior art module designs of the assignee of the present invention.
Figure 1B:
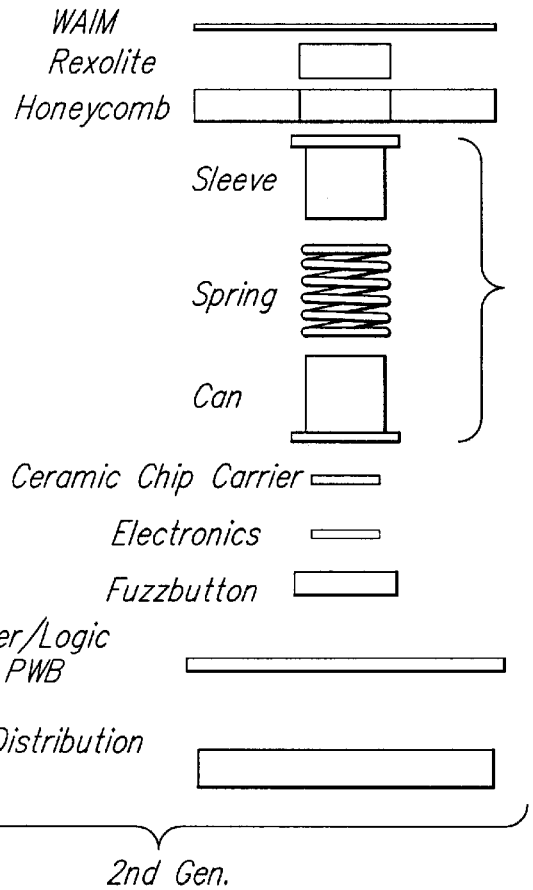
Prior Art FIG. 1b.
Figure 1C:
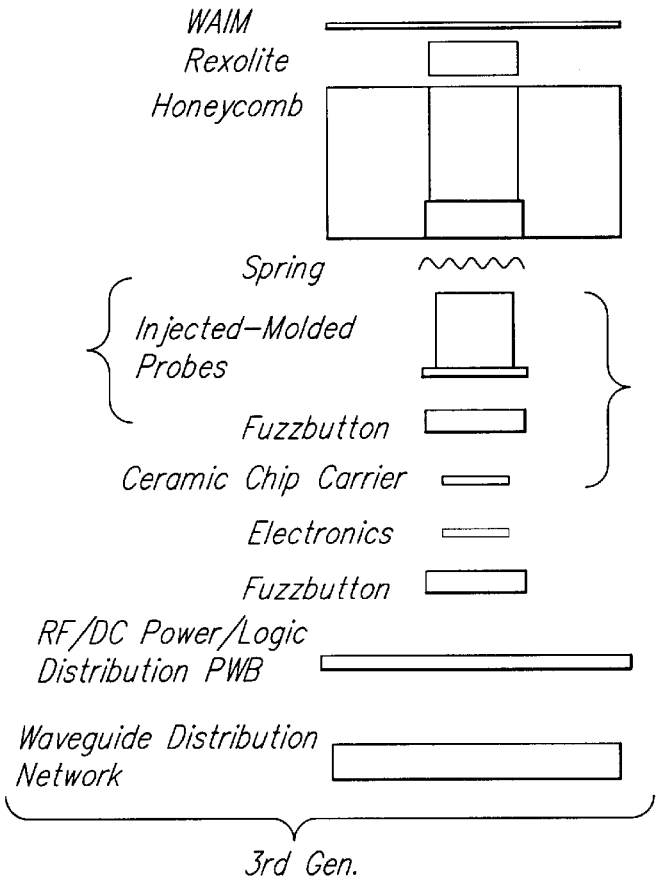
Prior Art FIG. 1c.

The module 10 of the present invention thus combines the injection-molded probes, button layer and holder, and the ceramic chip carrier shown in FIG. 1*c* hereof into a single integrated component part. The module 10 further performs the following functions:

an antenna honeycomb to circular waveguide interconnect;

an RF transition from the circular waveguide to a planar transmission line in the module 10;

controlled impedance transition from the ceramic to the electronics of the module 10;

DC power and logic signal interconnects between the ceramic and the printed wiring board of the module 10;

an RF transition from the ceramic to the printed wiring board; and a hermetic chip carrier for MMICs, ASICs and chip capacitors.

The construction of the module 10 of the present invention further provides an antenna designed with the ability to optimize the functional elements of the module 10 to produce superior RE antenna module performance with even fewer components, enhanced producibility and even lower overall costs than previously developed modules. The module 10 can be fabricated for a single radiator, as described herein, or in variable-sized subarrays. A sub-array configuration can take advantage of the area between the modules to house more electronics for additional functions or to facilitate multiple beams in a phased array antenna. The additional area also allows an increase in the maximum operating frequency of this type of module by accommodating tighter physical separation between antenna elements. The fact that multiple radiators can be integrated on a single multi-layer ceramic module also means that they can be interconnected in the ceramic using an HF distribution network. This significantly reduces the complexity and cost of the antenna printed wiring board that performs the next level of beam forming by reducing the number of RE/DC power/logic planes and interconnects. The resulting phased array antenna benefits from even fewer parts for assembly without adding cost to the antenna.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An integrated ceramic chip carrier module for a phased array antenna comprising:

at least one antenna probe formed on an antenna probe layer;

a chip carrier structure adapted to support an integrated circuit chip formed on an input/output layer;

an integrally formed waveguide layer disposed between said antenna probe layer and said input/output layer;

at least one electrical interconnect for electrically interconnecting said antenna probe and said integrated circuit chip; and wherein said antenna probe layer, said chip carrier structure and said electrical interconnect are integrally formed as a ceramic, co-fired muitilayer module.

2. The integrated chip carrier module of claim 1, wherein said module further comprises an integrally formed external ground connect plane layer disposed adjacent said antenna probe.

3. The integrated chip carrier module of claim 1, wherein said module further comprises a radio frequency (RF) and trace layer in electrical communication with said input/output layer.

4. An integrated ceramic chip carrier module for a phased array antenna comprising:

at least one radio frequency (RF) antenna probe formed within an RF antenna probe layer;

an input/output layer having a chip carrier structure adapted to support an integrated circuit chip;

a waveguide layer disposed inbetween said RF antenna probe layer and said input/output layer;

at least one vertical electrical interconnect for electrically interconnecting said antenna probe and said integrated circuit chip; and wherein said antenna probe layer, said input/output layer, said electrical interconnect are said waveguide layer are integrally formed as a single, ceramic, co-fired multilayer module.

5. The antenna module of claim 4, further comprising a radio frequency (RE) and trade layer disposed between said input/output layer and said waveguide layer.

6. The antenna module of claim 4, further comprising an HF back ground layer disposed between said RE probe and input/output layer.

7. The antenna module of claim 4, wherein said chip carrier structure comprises a hermetically sealed structure.

8. The antenna module of claim 7, wherein said chip carrier structure comprises a seal ring and a lid.

9. The antenna module of claim 7, wherein said chip carrier is implemented without a seal ring via a non-hermetic chip seal approach.

10. An integrated ceramic chip carrier module for a phased array antenna comprising:

a first co-fired ceramic layer having at least one radio frequency (RE) antenna probe formed thereon a second co-fired ceramic layer having an input/output layer having a chip carrier structure adapted to support a monolithic microwave integrated circuit (MMIC) chip;

a third co-fired ceramic layer forming a waveguide disposed between said first ceramic layer and said input/output layer;

a fourth co-fired ceramic layer having a radio frequency (RE) and trace circuit formed thereon; and at least one vertical electrical interconnect extending axially through a plurality of said layers for electrically interconnecting at least said antenna probe and said integrated circuit chip.

11. A phased array antenna comprising:

a support structure having a plurality of recesses for supporting a corresponding plurality of integrated antenna modules;

each said integrated antenna module including:

a first co-fired ceramic layer having a radio frequency (RE) probe formed thereon;

a second co-fired ceramic layer having an input/output layer having a chip carrier structure adapted to support a monolithic microwave integrated circuit (MMIC) chip;

a third co-fired ceramic layer forming a waveguide disposed between said first ceramic layer and said input/output layer;

a fourth co-fired ceramic layer having a radio frequency (HF) and trace circuit formed thereon; and at least one vertical electrical interconnect extending axially through a plurality of said layers for electrically interconnecting at least said antenna probe and said integrated circuit chip.

12. A method for forming an integrated ceramic chip carrier module for a phased array antenna comprising:

forming at least one antenna probe formed on a first ceramic layer;

forming an input/output circuit having a chip carrier structure adapted to support an integrated circuit chip, said input/output layer being formed on a second ceramic layer;

forming a waveguide from at least one third ceramic layer between said first ceramic layer and said second ceramic layer;

forming a plurality of electrical interconnects in each of said first, second and third ceramic layers which are vertically aligned with one another when said ceramic layers are disposed against one another, for electrically interconnecting at least said antenna probe and said input/output layer; and co-firing said first, second and third ceramic layers to produce said integrated ceramic chip carrier module.

13. The method of claim 12, further comprising the steps of:

forming a radio frequency (RF) and trace circuit on a fourth ceramic layer;

disposing said fourth ceramic layer between said second and third ceramic layers; and co-firing said fourth ceramic layer together with said first, second and third ceramic layers.

* * * * *

UNITED STATES PATENT AND TRADEMARK OFFICE

CERTIFICATE OF CORRECTION

PATENT NO. : 6,580,402 B2
DATED : June 17, 2003
INVENTOR(S) : Navarro et al.

It is certified that error appears in the above-identified patent and that said Letters Patent is hereby corrected as shown below:

Column 5,
Lines 14 and 30, “RE” should read -- RF--.
Line 27, “HF” should be -- RF --.

Column 6,
Line 5, “inbetween” should be -- between --.
Line 13, remove “single”.
Lines 16, 20, 32, 42 and 54, “RE” should read -- RF--.
Lines 20 and 63, “HF” should be -- RF --.

Signed and Sealed this

Twenty-third Day of March, 2004

JON W. DUDAS
*Acting Director of the United States Patent and Trademark Office*